US007533612B1

(12) United States Patent
Papayianis et al.

(10) Patent No.: US 7,533,612 B1
(45) Date of Patent: May 19, 2009

(54) PROJECTILE HEIGHT OF BURST DETERMINATION METHOD AND SYSTEM

(75) Inventors: Efthimios Papayianis, Dover, NJ (US); Thomas M. Crowley, Edison, NJ (US); Raymond S. Trohanowsky, Franklin, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 378 days.

(21) Appl. No.: 10/711,521

(22) Filed: Sep. 23, 2004

(51) Int. Cl.
*F42C 13/00* (2006.01)

(52) U.S. Cl. ..... 102/211; 102/215; 89/6.5

(58) Field of Classification Search ..... 102/211, 102/215, 425, 200, 276, 396; 89/6.5
See application file for complete search history.

(56) References Cited

U.S. PATENT DOCUMENTS 3,890,901 A * 6/1975 Anderson et al. ..... 102/255
4,456,202 A * 6/1984 Price et al. ..... 244/3.15
H776 H * 5/1990 Cole ..... 102/498
5,390,604 A * 2/1995 Ingersoll ..... 102/211
5,834,675 A * 11/1998 Boss ..... 89/6.5
5,886,287 A * 3/1999 Will et al. ..... 102/220
5,894,102 A * 4/1999 Oberlin et al. ..... 89/6.5
6,216,596 B1 * 4/2001 Wesson ..... 102/312
7,044,045 B2 * 5/2006 Ettmuller et al. ..... 89/6.5
2006/0103570 A1 * 5/2006 Hager et al. ..... 342/68

* cited by examiner

*Primary Examiner*—Michelle Clement
(74) *Attorney, Agent, or Firm*—John F. Moran

(57) ABSTRACT

A method and system optimally determines a desired Height of Burst (HOB) over a target based solely upon the time at which the projectile reached or passes through the apogee or apex of its trajectory ($t_a$). There are several modes of implementation. According to one mode, the downleg is determined as a percentage of the upleg. According to another mode, the time to Height Of Burst ($t_{HOB}$) is calculated algebraically based substantially solely upon the time to height of apogee $t_a$.

5 Claims, 2 Drawing Sheets

CHARGE 0,1,2,3 AND 4-1511 mils AT 70°F

PROJECTILE HEIGHT OF BURST DETERMINATION METHOD AND SYSTEM

FEDERAL INTEREST STATEMENT

The invention described herein may be manufactured, used and licensed by or for the U.S. Government for U.S. Government purposes.

BACKGROUND OF THE INVENTION

1. Field of the Invention

The invention relates to a method and system for determining when a projectile reaches a desired Height Of Burst (HOB) over a target based solely upon the time at which the projectile reaches or passes through the apogee or apex of its trajectory.

2. Description of Related Art

There are many types of projectiles that are designed to perform a function, such as detonation, at an optimal Height Of Burst (HOB) over a target. For example, an illumination round is designed to deploy a flare to spot enemy targets at night. Similarly, some smoke rounds are designed to burst at a specified HOB in order to obtain optimal dispersion of the smoke cloud over the target.

According to the prior art, a typical time fuse is used to function, i.e., detonate, the projectile when it reaches the desired HOB. A fairly complex set of parameters have to be entered into the system in order to accurately detonate the projectile at the desired HOB. First, the locations of the weapon and the target are required. Then a ballistics solution is computed to determine the angle it should be fired at; the velocity it should be fired at; and the time of flight at which the projectile will reach the desired HOB over the target. Other variables that affect the accuracy of this ballistics solution include meteorological conditions and propellant temperature. The complexity of prior art solutions increases the chances of error. Clearly a simpler and more robust method and system for determining accurately HOB over target is desired. It was in the context of the foregoing prior art that the present invention arose.

SUMMARY OF THE INVENTION

Basically described, the invention comprises a method and system for determining the time at which a projectile reaches a desired HOB over target calculated solely by the time $t_a$ at which the projectile reaches or passes through its apogee during its trajectory. This principle can be used to improve the design of existing fuses or to design new improved fuses. The present invention depends, in part, upon the realization that the time $t_{HOB}$ can be determined substantially solely from the time to apogee $t_a$ independent of firing angle. Using that insight there are several different ways of determining the time to $t_{HOB}$. According to one embodiment of the invention, the down leg time can be determined solely as a percentage of the up leg time $t_a$. Accordingly to another, preferred embodiment of the invention, the optimal $t_{HOB}$ can be algebraically derived. These features can be further understood by reference to the following drawings.

DETAILED DESCRIPTION OF THE PREFERRED EMBODIMENT

During the course of this description, like letters are used to indicate like elements according to the different figures that illustrate the invention.

Figure 1:
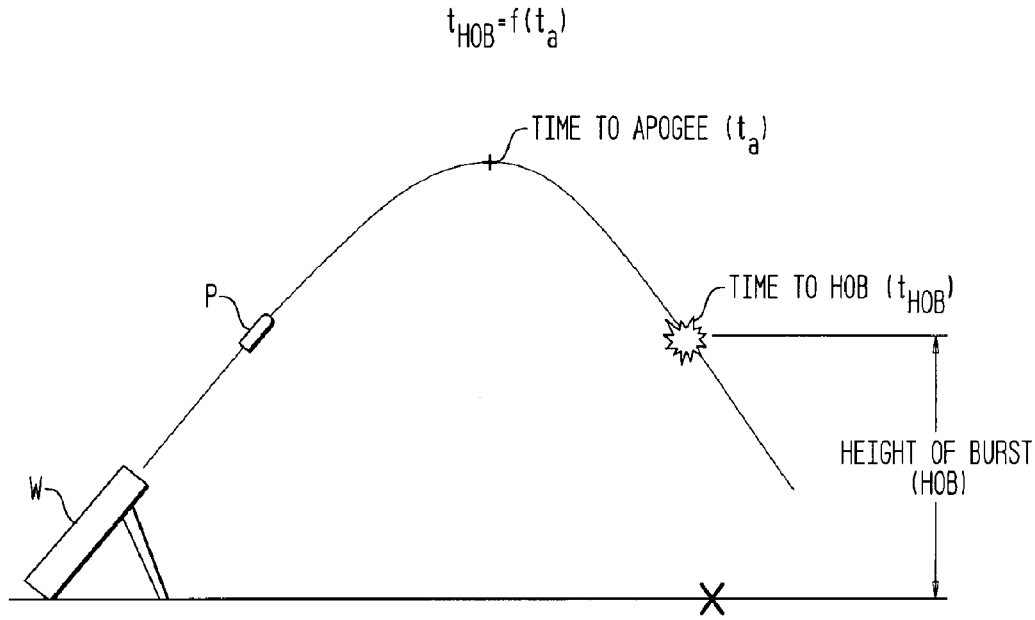
FIG. 1 illustrates a typical projectile path illustrating the time of the projectile to apogee $t_a$ and the time of the projectile to burst $t_{HOB}$.
Figure 2:
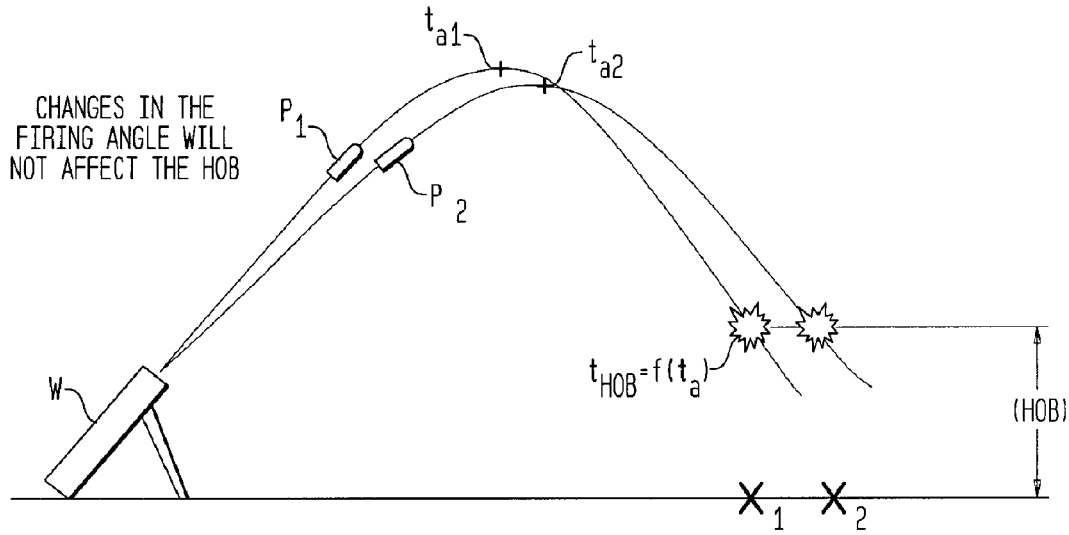
FIG. 2 illustrates the fact that changes of the firing angle do not substantially affect the Height Of Burst according to the present invention.

FIG. 1 illustrates a typical projectile flight. Initially the projectile is launched from a weapon W at a specific location. It climbs to an apogee or apex at a point $t_a$ and then descends to the point of bursting at a time $t_{HOB}$ at a Height Of Burst (HOB) above the target X. Part of the basic insight of the present invention is the fact that the time to HOB ($t_{HOB}$) can be determined accurately merely by knowing the time to apogee ($t_a$) regardless of the firing angle of the Projectile. As shown in FIG. 2, a pair of projectiles $P_1$ and $P_2$, respectively reach their apogees at $t_{a1}$ and $t_{a2}$, respectively. Based upon that information alone the time to Height Of Burst ($t_{HOB}$) can be calculated respectively above targets $X_1$ and $X_2$ wherein the HOB is identical for both projectiles $P_1$ and $P_2$. This functionality can be programmed into the fuse employed by projectiles $P_1$ and $P_2$.

Specifically, the fuse can determine the time when the projectile will reach a specified Height Of Burst ($t_{HOB}$), based on measuring the time it took to reach apogee ($t_a$). A timer in the fuse is initiated as soon as the projectile is fired from the weapon. A sensor is used to determine when the projectile reaches apogee. Electronics then uses an algorithm to calculate the time at which the projectile will reach the desired HOB, based on the flight time between launch from weapon W and apogee ($t_a$). The fuse arms and functions the projectile when $t=t_{HOB}$.

The foregoing has the following benefits. Using $t_{HOB}=f(t_a)$ to determine when the projectile should function, makes the HOB totally independent of factors such as the angle at which the weapon is fired, launch velocity, time of flight, propellant temperature, meteorological conditions, etc. Even if the projectile is fired at a different angle and with a different velocity, it will still function at the same HOB. The only information required to determine an HOB setting is the difference in altitudes between the weapon W and target locations X, and $X_2$.

Eliminating these sources of variability and errors can improve the accuracy, reliability, predictability, consistency and flexibility of fire control. The firing crew can even adjust fire to get the projectile closer to the target and these adjustments will not affect the HOB.

There are general methods or algorithms that can be used to determine the time at which the projectile will reach a desired HOB, based on the time it took to reach apogee ($t_a$). The best solution for any specific type of projectile depends on the accuracy that is required and the cost that can be afforded. Two representative methods are described below.

Method 1—Projectile Motion Equations

Elementary physics provides projectile motion equations for the ideal case of a point mass moving through a vacuum. Algebraic manipulation of these equations provides an empirical relationship between the time to apogee ($t_a$) and time to any desired HOB ($t_{HOB}$):

$$t_{HOB}=t_a+\sqrt{t_a^2-2\times\mathrm{HOB}/g}+C$$

where $g=9.81\ \mathrm{m/sec^2}=32.2\ \mathrm{ft/sec^2}$ and C=correction factor Therefore, when the projectile P is fired, the fuse measures the time to apogee ($t_a$) and plugs this into an equation, to calculate the time when the projectile P will arrive at the desired HOB ($t_{HOB}$).

These calculations do not account for aerodynamic effects that the projectile experiences during flight, such as drag. Therefore, the $t_{HOB}$ calculated by this method will always be less than the actual time at which the projectile will reach the desired HOB. For example, the actual time to reach the desired HOB at minimum range may be 0.5 seconds later than the time calculated by the method above; and the time to reach HOB at the maximum range may be 1.5 seconds later. For this type of projectile, a correction factor of 1 second can be added to the equation above. This would assure that the calculated valuation of $t_{HOB}$ is always with +/−0.5 seconds of the actual time of HOB.

This algorithm can be refined, by selecting a more accurate correction factor based on the time to apogee ($t_a$). For example, the correction factor can be selected from a reference table, such as the following:

If $t_a$>12 seconds then C=1.0 sec

If 12 sec>$t_a$>9 seconds then C=0.75 sec

If 9 sec>$t_a$>7 seconds then C=0.5 sec

If $t_a$<7 seconds then there may be a malfunction and the fuse should not function the round.

The accuracy of this type of algorithm can be increased by increasing the number of time segments. Curve fitting techniques can also be used to determine the coefficients of a polynomial equation that provides a more accurate or at least "smoother" calculation for the correction factor (C) as a function of $t_a$, such as:

$$C=a+b(t_a)+c(t_a)^2+d(t_a)^3+\ldots$$

where a, b, c, d . . . are the polynomial coefficients

A further improvement to this type of algorithm would be to program the fuse with a trajectory simulation model that can more accurately represent the true trajectory of the projectile during flight. Therefore, when the projectile is fired, the fuse would measure the actual time to reach apogee. An algorithm could be based on fundamental equations of motion or an advanced trajectory simulation model to calculate $t_{HOB}$. The fuse arms and functions the projectile when $t=t_{HOB}$.

Method 2—Downleg Time=N % of Upleg Time

This method is based on relating the upleg time and downleg time of the projectile's flight. The upleg time is the time from launch to apogee ($t_a$). The downleg time is the time from apogee to the desired HOB. For example, a suitable HOB may be obtained by simply functioning the projectile when the downleg time is 90% of the upleg time. This would assure that the projectile always functions in less time than it took to reach apogee.

Figure 3:
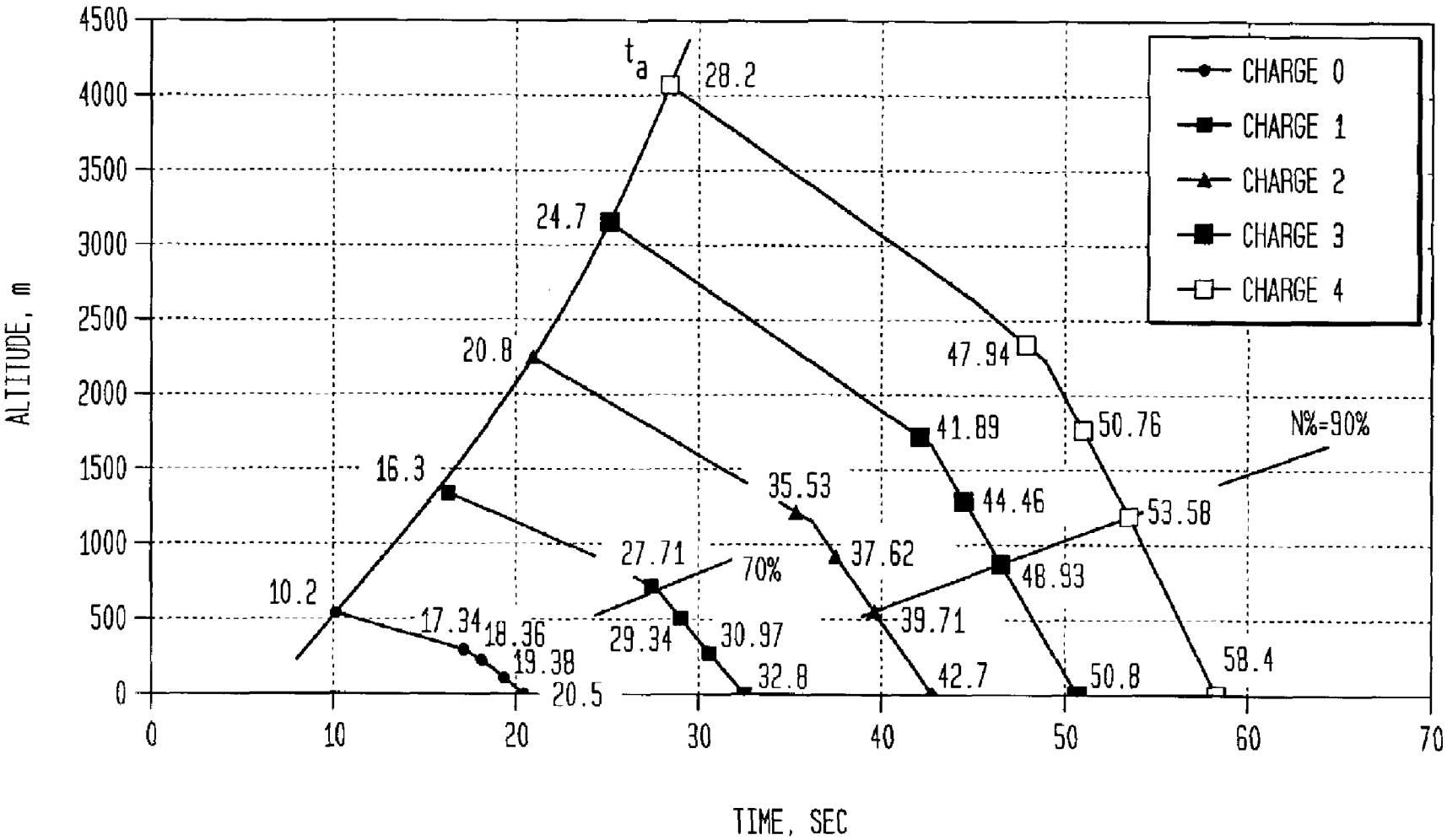
FIG. 3 is a chart illustrating the altitude of projectile when the down leg time N % is a percentage of the up leg time $t_a$ and wherein N % is 70%, 80% and 90%.

The chart shown in FIG. 3 illustrates the altitude of a projectile when N % is 70%, 80% and 90%. For example, when the projectile is fired at charge 4 (max velocity), then the altitude it reaches at apogee is about 4,000 meters. If the downleg time is 70% of the upleg time, then the HOB of the projectile will be about 2,400 meters. Similarly, at 80% the HOB will be 1,700 meters and at 90% it will be 1,200 meters.

If the fuse algorithm were set to always function the projectile when the downleg time is 90% of the upleg time, the resulting HOB would vary from 1,200 meters at charge 4 to nearly ground level at charge 0. To reduce this variation, the fuse algorithm can reference a table of N % values, such as the following:

If $t_a$>12 seconds then downleg time=90% of $t_a$

If 12 sec>$t_a$>9 seconds then downleg time=70% of $t_a$

If 9 sec>$t_a$>7 seconds then downleg time=10% of $t_a$

If $t_a$<7 seconds then there may be a malfunction and the fuse should not function the round.

The accuracy of this type of algorithm can be increased by increasing the number of time segments. Curve fitting techniques can also be used to determine the coefficients of a polynomial equation that provides a more accurate or at least "smoother" calculation for the correction factor (N) as function Of $t_a$, such as:

$$N=a+b(t_a)+c(t_a)^2+d(t_a)^3+\ldots$$

where a, b, c, d . . . are the polynomial coefficients

Therefore, when the projectile is fired, the fuse would measure the actual time to reach apogee. The algorithm would determine the correct value of N %, based on the time measured for $t_a$ and then calculate $t_{HOB}$. The fuse arms and functions the projectile when $t=t_{HOB}$.

Sensors for Detecting Apogee

There are a growing number of sensors that can be used to detect when a projectile has reached apogee or determine when the projectile had passed through apogee. The following is a short summary of some of these sensor candidates. The best solution will depend on factors such as the accuracy required for the specific application; the profile of the trajectory; the cost that can be afforded; and the volume that is available to accommodate the sensor. Other considerations for sensor selection include the environments that it must be able to withstand when the projectile is fired (e.g.; axial acceleration, rotational acceleration); and atmospheric conditions (e.g.; rain, snow, temperature extremes, etc.).

For some applications, a suitable accelerometer may be used for detecting apogee. The accelerometer must withstand significant acceleration during launch. It may be able to sense the drag forces during flight. The projectile may become weightless at apogee. A gyroscope may be used to sense when the projectile transitions from a "nose up" to a "nose down" orientation. If the projectile reaches sufficient altitudes, then a barometric sensor may be used to determine when apogee was reached.

A velocity sensor can be used to detect when the projectile is launched and when it passes through its apogee. A pitot tube can be exposed to the air stream during flight for such a purpose. A small turbine may also be employed. As airflow passes through the turbine, the speed or output of the turbine can be used to detect when the projectile passes through its apogee.

Other more advanced sensor technologies include a global positioning sensor (GPS), an integrated inertial measuring unit; or a micro electronic mechanism (MEM). In some cases, additional electronics may be required to record the sensor measurement during flight and then extrapolate back to determine when the projectile actually passed through apogee.

Preferred Method

An electronic time fuse can be designed that is powered by a turbo alternator. When that projectile is fired, the turbo alternator will begin generating electricity to automatically power up the fuse. The airflow through the turbo alternator will decrease as the projectile approaches apogee and then increase again after apogee. Electronics will monitor the performance of the turbo alternator to determine the time at which the projectile passed through its apogee ($t_a$). Then the fuse will use this value of $t_a$, that is measured during the actual flight of the projectile, to compute the time to HOB ($t_{HOB}$) with the following relationship:

$$t_{HOB}=t_a+\sqrt{t_a^2-2\times\mathrm{HOB}/g}+C$$

The fuse arms and functions the projectile when $t=t_{HOB}$.

In summary, this invention is for determining the time at which a projectile will reach a desired HOB over a target ($t_{HOB}$), based on the actual measured time, for it to reach its apogee during flight ($t_a$). This can be accomplished by designing an electronic time fuse that is powered by a turbo alternator. When the projectile is fired, the turbo alternator will begin generating electricity to automatically power up the fuse. The airflow through the turbo alternator will decrease as the projectile approaches apogee and then increase again after apogee. Electronics will monitor the performance of the turbo alternator to determine the time at which the projectile passed through its apogee ($t_a$). Then the fuse will use this value of $t_a$, that is measured during the actual flight of the projectile, to compute the time to HOB ($t_{HOB}$) with the following relationship:

$$t_{HOB}=t_a+\sqrt{t_a^2-2\times HOB/g}+C$$

The fuse arms and functions the projectile when $t=t_{HOB}$.

This makes the HOB totally independent of factors such as the angle at which the weapon is fired, launch velocity, time of flight, propellant temperatures, meteorological conditions, etc. Eliminating these sources of variability and errors will improve the accuracy, reliability, predictability and consistency of the projectile function. The only information required to determine an HOB setting is the difference in altitudes between the weapon and target locations. Even if the projectile is fired at a different angle and different velocity, it will still function at the same HOB. The firing crew can adjust fire to get the projectile closer to the target, and these adjustments will not affect the HOB. This will improve the flexibility of fire control for the projectile.

While the invention has been described with reference to the preferred embodiment thereof, it will be appreciated by those of ordinary skill in the art that various modifications can be made to the method and system described without department from the spirit of the invention as a whole.

What is claimed is:

1. A method of determining the time $t_{HOB}$ to a desired Height Of Burst (HOB) of a projectile comprising the steps of:

a. determining, through the effect of a sensor on-board the projectile, when the projectile reaches its apogee after launch;

b. measuring the actual time $t_a$ that it takes said projectile to reach the apogee after launch; and c. calculating the time to the desired Height Of Burst $t_{HOB}$ based upon the actual measured time $t_a$;

wherein said on-board sensor is one selected from the group consisting of: accelerometric sensor, gyroscopic sensor, velocity sensor, global positioning sensor, inertial sensor, and MEMs.

2. The method of claim 1 wherein the calculating step c above comprises setting the $t_{HOB}$ as a percentage X % of $t_a$ wherein said percentage is less than 100% and wherein $t_{HOB}=t_a+X\ \%\ t_a t_a$.

3. The method of claim 2 wherein said percentage of $t_a$ is calculated as follows:

if $t_a>12$ seconds then down leg time=90% of $t_a$;

if 12 sec>$t_a$>9 seconds then down leg time=70% of $t_a$;

if 9 sec>$t_a$>7 seconds then down leg time=10% of $t_a$;

if $t_a<7$ seconds then there may be a malfunction and the projectile should be disabled.

4. The method of claim 1 wherein said step c is calculated as follows:

$$t_{HOB}=t_a+\sqrt{t_a^2-2\times HOB/g+C}$$

where $g=9.81\ m/sec^2=32\ ft/sec^2$ and C=correction factor.

5. The method of claim 4 wherein said correction factor C is calculated as follows:

if $t_a>12$ seconds then C=1.0 sec;

if 12 sec>$t_a$>9 seconds then C=0.75 sec;

if 9 sec>$t_a$>7 seconds then C=0.5 sec;

if $t_a<7$ seconds then there may be a malfunction and the projectile should be disabled.

* * * * *